US006112665A

United States Patent [19]

Teter et al.

[11] Patent Number: 6,112,665

[45] Date of Patent: Sep. 5, 2000

[54] METHOD AND COMPUTER GENERATED SWATCH CARDS FOR MATCHING COLORS

[75] Inventors: James R. Teter, Minneapolis; Thor A. Olson, Minnetonka, both of Minn.

[73] Assignee: Electronics For Imaging, Inc., Foster City, Calif.

[21] Appl. No.: 09/262,571

[22] Filed: Mar. 4, 1999

[51] Int. Cl.[7] ..... B41M 3/00; G01J 3/52

[52] U.S. Cl. ..... 101/483; 101/494; 356/421; 428/43

[58] Field of Search ..... 101/483, 494; 356/421; 428/43

[56] References Cited

U.S. PATENT DOCUMENTS

| | | | |
|---|---|---|---|
| D. 419,185 | 1/2000 | Teter et al. | D19/1 |
| 1,429,436 | 9/1922 | Kelly | 428/43 |
| 1,774,497 | 8/1930 | Wandel | 428/43 |
| 4,110,502 | 8/1978 | Baer | 428/40 |
| 5,997,683 | 12/1999 | Popat | 156/277 |

FOREIGN PATENT DOCUMENTS

| | | | |
|---|---|---|---|
| 794233 | 3/1994 | Canada | 428/43 |
| 2552021 | 12/1985 | France . | |
| 2695349 | 3/1994 | France . | |

OTHER PUBLICATIONS

Anon., "Trumatch Color Swatching System," TypeWorld, vol. XV, No. 1, pp. 1,4 Jan. 1991.

*Primary Examiner*—John S. Hilten
*Assistant Examiner*—Daniel J. Colilla
*Attorney, Agent, or Firm*—Barry R. Lipsitz

[57] ABSTRACT

A blank is provided for producing color swatches on a color printer or photocopier. A sheet adapted to be fed through the printer or photocopier contains a first set of perforations defining the perimeter of a swatch card. A second set of perforations disposed within the perimeter of the swatch card defines a plurality of openings. The openings are punched out, preferably after color swatches have been printed on the swatch card, in order to enable the viewing of a sample color through the opening for comparison with the color swatches. A third set of perforations is provided in a corner of the swatch card to enable a plurality of swatch cards to be assembled into a reference deck by passing a fastener through holes formed via the third set of perforations. Each sheet can have a plurality of swatch cards laid out therein, with each swatch card containing a plurality of color swatches.

20 Claims, 4 Drawing Sheets

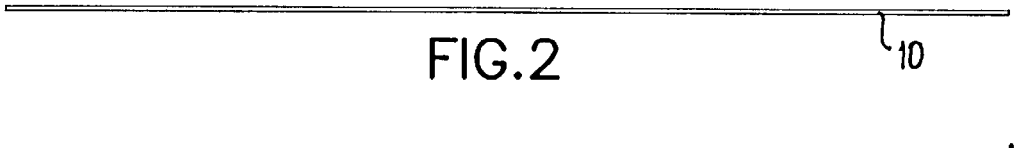
FIG.2
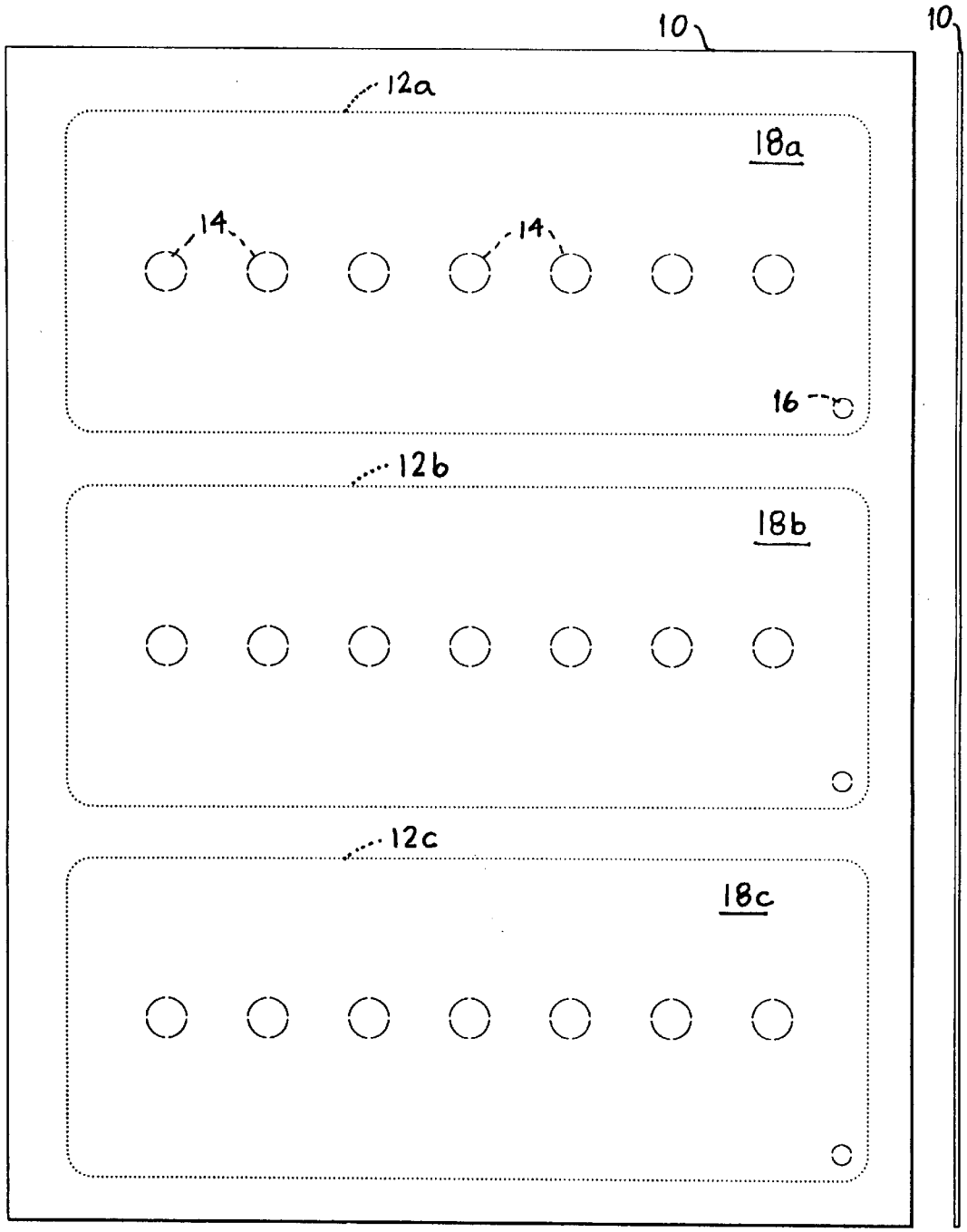
FIG.1
FIG.3

METHOD AND COMPUTER GENERATED SWATCH CARDS FOR MATCHING COLORS

BACKGROUND OF THE INVENTION

The present invention relates to the selection and matching of computer generated colors output by a color printer or photocopier, and more particularly to a computer generated swatch card system for printing spot colors in a patch format so that they can be easily compared to other colors. Typical uses for the swatch cards produced include comparison of the printed, computer generated colors with reference or target colors, documentation of spot colors for a particular graphic project, and communication of colors to other color suppliers or vendors.

In addition to the common components of text and images, page layouts will often contain graphic elements that are to be printed with a specific color. On large printing presses, these "spot" colors are printed using additional individual plates, each using an ink that makes the color. On smaller printers, or in proofing, the spot colors must be simulated using a combination of the colorants utilized by the printer. These are usually the CMYK "process" inks, i.e., cyan, magenta, yellow and black. While certain standard tables exist for the simulation of some industry colors using standard ink sets, there is a general problem of finding the correct combination of colorant amounts to enable a given printer to match a particular spot color. There is a further problem of finding colorant amounts to match other targets, beyond those of spot color inks, such as colors of textiles and other colored objects.

A graphic artist or printer operator currently either accepts an approximate color match, based on simplistic or inappropriate color models for the particular printer in use, or uses a trial and error process to find a visual match to a desired spot color. It would be advantageous to provide tools that facilitate a person's matching of colors to samples. It would be further advantageous to provide a record of color samples that pertain to a particular project, such as a graphic printing project, advertising campaign, product color scheme, or the like.

The present invention provides a blank for producing color swatches as well as methods for producing and using such blanks, all having the aforementioned and additional advantages.

SUMMARY OF THE INVENTION

In accordance with the present invention, a blank is provided for producing color swatches. The blank comprises a sheet (e.g., paper or plastic) adapted to be fed through a color printer or photocopier. A first set of perforations is provided in the sheet defining the perimeter of a swatch card. A second set of perforations can also be provided. The second set of perforations is disposed within the perimeter of the swatch card and defines a plurality of openings. The openings appear upon the removal of portions of the sheet defined by the second set of perforations.

The blank can further comprise a third set of perforations in a corner of the swatch card for providing a corner opening upon the removal of portions of the sheet defined by the third set of perforations. The corner opening allows a plurality of swatch cards to be assembled into a reference deck by passing a common fastener therethrough.

In an illustrated embodiment, the sheet has a plurality of swatch cards laid out therein. Each of the swatch cards has the first, second and third sets of perforations. In particular, an embodiment is illustrated with three swatch cards laid out per sheet, wherein the second set of perforations in each swatch card defines a series of seven circular openings running substantially along a longitudinal center axis of the swatch card.

Although the swatch cards can be any shape, the illustrated embodiment depicts them as substantially rectangular in shape. Moreover, although the sheet can be any size accommodated by the color printer or copier, it will typically be standard letter or A4 size. In the illustrated embodiment, the sheet has a length greater than its width and the swatch cards are substantially equidistantly spaced along the length.

Preferably, the swatch cards are laid out on the blank such that the first and second sets of perforations are symmetrically arranged. In this manner, the blank can be inserted into the printer or photocopier in any orientation and still have the printed swatches land properly centered on the openings provided by the second set of perforations and extending to the edge of the swatch card as defined by the first set of perforations.

A method is provided for matching a desired color to a computer generated color. A plurality of computer generated color swatches is printed on a blank form having a first set of perforations defining the perimeter of a swatch card. A second set of perforations disposed within the swatch card and intersecting portions of the printed swatches can also be provided. The swatch card is removed from the blank form along the first set of perforations after the color swatches have been printed thereon. Portions of the swatch card defined by the second set of perforations, if provided, are removed to create openings in the printed swatches. The swatch card is laid over a desired color to be matched such that the desired color shows through an opening in a printed swatch. In this manner, a comparison of the desired color and the printed swatch color can be easily and accurately made. Alternatively, the swatch card and color to be matched can be placed side-by-side so that the colors on the edge of the swatch card can be compared to the adjacent color to be matched.

The printed swatches are registered on the swatch card such that each swatch has an opening therein defined by perforations of the second set. The respective perforations of the second set are removed to provide the opening in each printed swatch. The swatch card can be provided with a third set of perforations defining a corner opening that can be punched out of the card. By punching out the corner opening in each of a selected set of swatch cards, the selected set can be assembled into a fan deck by passing a common fastener through the corner openings in the set of swatch cards.

In the illustrated embodiment, three swatch cards are printed on the form and removed along respective first sets of perforations. Each of the swatch cards has a plurality of swatches printed thereon. The printed swatches are registered on the swatch cards such that each swatch has an opening therein defined by perforations of the second set. The respective perforations of the second set are removed to provide the openings.

BRIEF DESCRIPTION OF THE DRAWINGS

FIG. 1 is a plan view of a blank in accordance with the, present invention having three perforated swatch cards laid out thereon;

FIG. 2 is a top edge view of the blank of FIG. 1, the bottom edge view being identical;

FIG. 3 is a right side edge view of the blank of FIG. 1, the left side edge view being identical;

DETAILED DESCRIPTION OF THE INVENTION

FIG. 1 illustrates a blank 10 for producing color swatches on a color printer or photocopier. The color swatches are generated by a computer using appropriate software, such as the EDOX™ document server software available from Management Graphics, Inc. of Minneapolis, Minn., the assignee of the present invention. The blank 10 comprises a sheet of paper, plastic or other substrate suitable for feeding through a color printer or photocopier. For example, the blank 10 can comprise a letter size sheet of 60 pound (162 g/m$^2$) paper. It should be appreciated that other sizes, weights and materials can be used for the blank 10.

The blank 10 of FIG. 1 is configured to produce three separate swatch cards 18*a*, 18*b* and 18*c*. Each swatch card is defined by a respective first set of perforations 12*a*, 12*b*, 12*c*, which outlines the perimeter of the swatch card. A second set of perforations 14 is optionally provided in the sheet (e.g., paper sheet) forming blank 10. The second set of perforations is disposed within the perimeter of the swatch card and defines a plurality of openings (e.g., holes) that can be formed upon the removal of portions of the sheet defined by the perforations 14.

Figure 6:
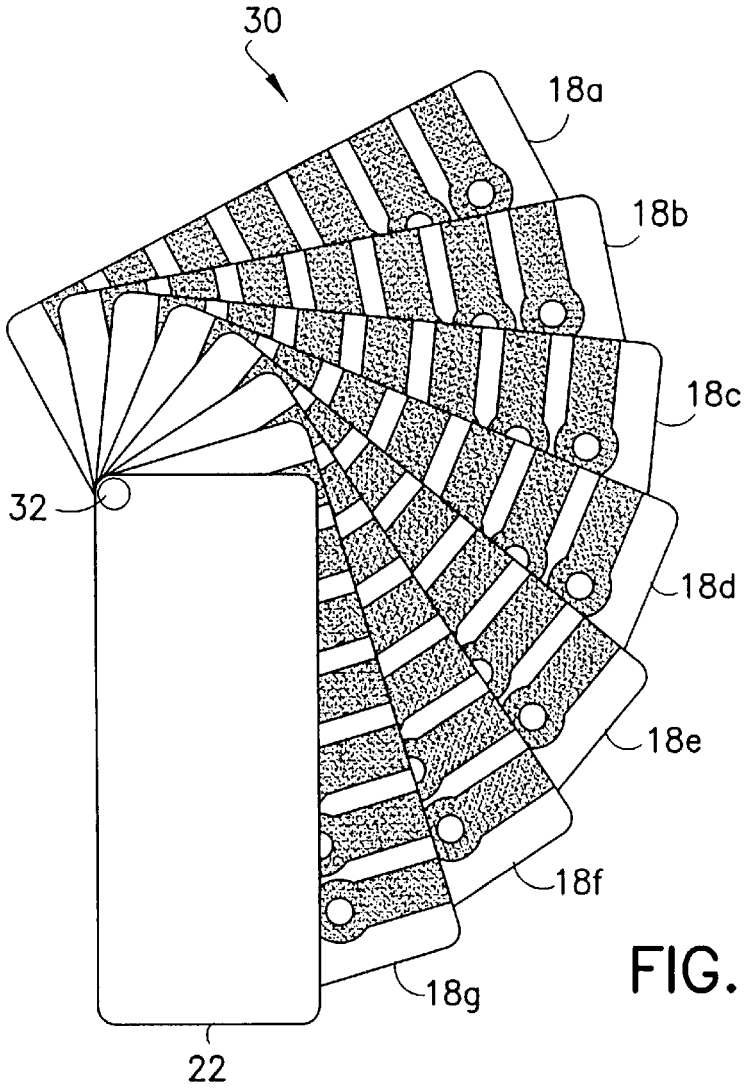
FIG. 6 illustrates a fan deck of swatch cards assembled in accordance with the present invention.
Figure 7:
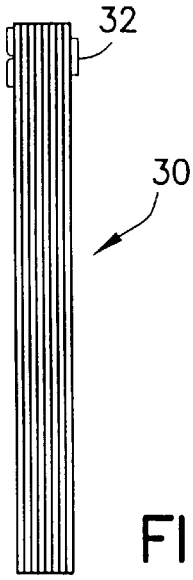
FIG. 7 is a side view of the fan deck of FIG. 6 in the closed position.

A third set of perforations 16 is optionally provided in a corner of each swatch card. The perforations 16 enable a corner opening 17 to be punched from each swatch card. The corner openings allow a plurality of swatch cards to be assembled into a reference deck 30 illustrated in FIGS. 6 and 7, by passing a common fastener 32 therethrough. Fastener 32 can comprise, for example, a standard brass prong paper fastener. As illustrated in FIGS. 6 and 7, the fan deck comprises a plurality of swatch cards 18*a* through 18*g*. It should be appreciated that any number of swatch cards can be assembled into a fan deck. A blank or imprinted cover sheet 22 can optionally be provided.

Figure 4:
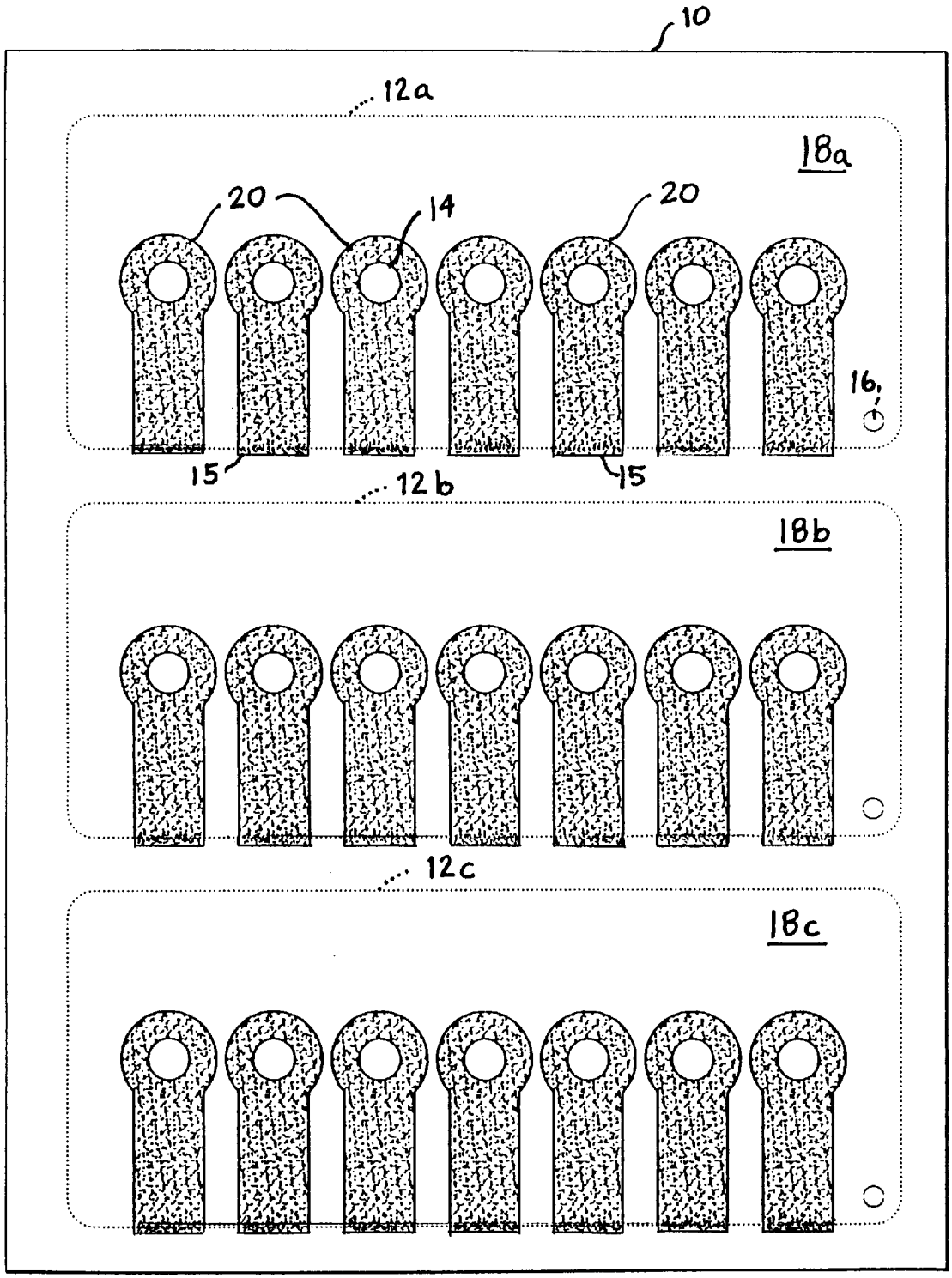
FIG. 4 is a plan view of the blank of FIG. 1 after color swatches have been printed thereon.
Figure 5:
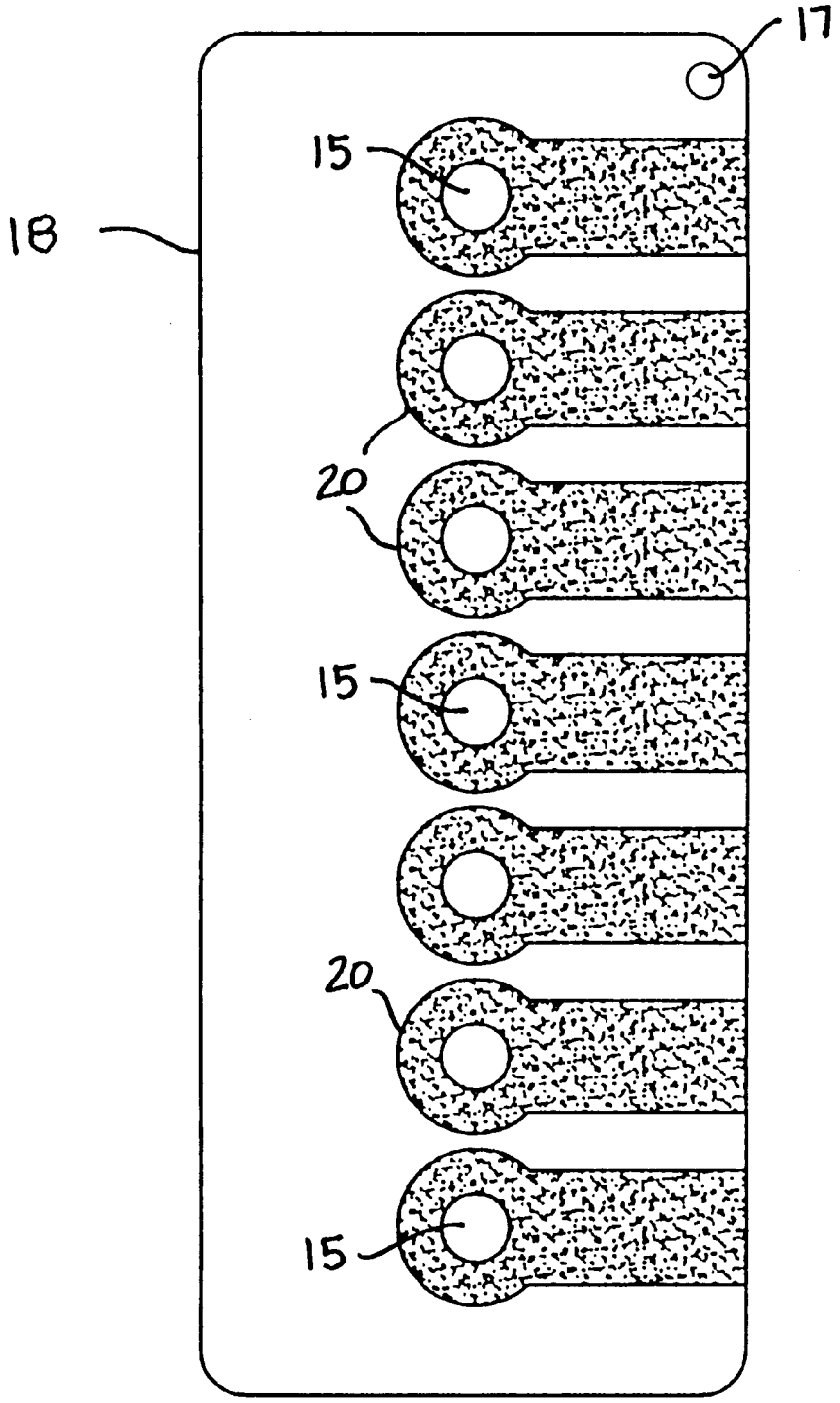
FIG. 5 is a plan view of a completed swatch card.

In order to produce the swatch cards, the blank 10 is passed through a color printer or color copier for the printing of color swatches thereon. FIG. 4 illustrates the blank 10 after it has been run through the color printer or copier, which prints the swatches 20 thereon. As illustrated in FIG. 4, the swatches 20 are aligned such that each swatch overlaps a different opening defined by perforations 14. In addition, in the preferred embodiment, the swatches are printed so that their bottom edges 21 slightly overlap the respective first set of perforations 12*a*, 12*b*, 12*c*. In this manner a "full bleed" effect is obtained so that the color runs to the very edge of the completed swatch card. This provides a convenient way to make color comparisons using the edge of the card. The edge of the card is sometimes the preferred place at which to make color comparisons, for example, when it is inconvenient or unnecessary to make a color comparison using the holes provided by punching out the openings 15 (FIG. 5). For large areas of color, or for very quick visual comparisons, the edge of the card can be used. In this case, it is not necessary to form the holes in the swatch card by punching out the openings 15.

At the time the blank 10 is run through the printer or copier, the openings 15 have not been formed by punching out the material delineated by perforations 14. In the preferred embodiment, the openings 15 are only formed by punching out the material along the perforations 14 after the blank has been run through the printer or copier. This reduces the possibility of paper jams or the like while the swatch colors 20 are being printed.

After the swatch colors 20 have been printed and the blank 10 has been output from the color copier or printer, the individual swatch cards 18 (e.g., 18*a*, 18*b*, 18*c*) can be separated from the blank along the perforations 12 (e.g., 12*a*, 12*b*, 12*c*) to form an individual swatch card 18 as illustrated in FIG. 5. The openings 15 in each of the printed swatches are formed by punching along perforations 14. A hole 17 is provided by punching out the perforations 16. As indicated above and illustrated in FIGS. 6 and 7, the hole 17 is used to form the fan deck 30 by passage of the fastener 32 therethrough.

It is advantageous to perforate the blanks such that the first and second sets of perforations are laid out symmetrically on the blank. The purpose of a symmetric arrangement is to allow the blank to be inserted into the copier or printer in any orientation and still have the printed swatches land properly centered on the holes 15 and extending to the edge of the swatch card. There are four possible orientations in which the unprinted blank can inserted into the copier or printer. These are right side up ±180° and right side down ±180°. Typically, the blank will be plain white cardstock, so it may be printed either side up, but the pattern of the first and second perforations must be symmetric for the printed swatches to land at the proper positions.

Depending on the exact orientation of the blank when printed, the fastener holes 17 defined by perforations 16 will end up in one of the four corners of the swatch cards. This is acceptable as long as all of the swatch cards are consistent. Thus, the corner perforations 16 do not need to be symmetrically laid out since the fan decks can still be assembled with all of the swatches oriented in the same direction. However, if desired, two diagonally opposing corners (or even all four corners) of each swatch card could be perforated. It is noted that in FIG. 6, the orientation of all of the swatches is the same, even though the corner of the cards through which fastener 32 is inserted is not the same corner where hole 17 is illustrated in FIG. 5.

The stippling in FIGS. 4 and 5 is used to indicate different printed colors, without indicating any specific color. As will be appreciated by those skilled in the art, the software driving the color printer or copier can be used to generate any conceivable range of colors for printing on the swatch cards. The colors of the consecutive swatches can be related, or totally independent of each other, depending on the final use for the swatch cards. Typical uses include the provision of swatches for comparison with reference or target colors, documentation of spot colors for particular graphic projects, and communication of colors to other color suppliers or vendors in order to enable, for example, a printer to print an exact custom color generated by the user's computer. By virtue of the holes 15, the swatch cards can be conveniently laid on top of a printed color or product sample in order to obtain the best match possible. Placing the swatches 20 over a product whose color is to be matched and viewing the product color through the hole 15 is preferable to simply laying a swatch next to the color to be matched, as the visual perception is more accurate when the color being matched appears through a hole with the computer generated color completely encircling the underlying sample color. However, the swatch cards can still be used by placing them adjacent to a color to be matched, since the printed swatches extend all the way to the edge of the cards.

It should now be appreciated that the present invention provides a blank for producing computer generated color swatches as well as a method for matching a desired color to a computer generated color. The swatch cards and methods of the present invention utilize a novel blank 10 that can be run through a conventional color printer or color copier.

Although the invention has been described in connection with a specific illustrated embodiment, it should be appreciated that numerous adaptations and modifications may be made thereto without departing from the scope of the invention as set forth in the claims. For example, any number of swatch cards can be produced on a blank, and any number of holes can be formed by the series of second perforations 14.

What is claimed:

1. A swatch card blank for producing color swatches comprising:

a sheet adapted to be fed through a color printer or photocopier;

a first set of perforations in said sheet defining the perimeter of a swatch card; and a second set of perforations in said sheet disposed within the perimeter of said swatch card and defining a plurality of openings, said openings appearing upon the removal of portions of said sheet defined by said second set of perforations.

2. A blank in accordance with claim 1 further comprising a third set of perforations in a corner of said swatch card for providing a corner opening upon the removal of portions of said sheet defined by said third set of perforations, said corner opening allowing a plurality of swatch cards to be assembled into a reference deck by passing a fastener therethrough.

3. A blank in accordance with claim 2 wherein said sheet has a plurality of swatch cards laid out therein, each swatch card having said first, second and third sets of perforations.

4. A blank in accordance with claim 3 wherein said sheet has a total of three swatch cards laid out therein.

5. A blank in accordance with claim 4 wherein the second set of perforations in each swatch card defines a series of openings running substantially along a longitudinal center axis of the swatch card.

6. A blank in accordance with claim 5 wherein said first and second sets of perforations are laid out symmetrically on said sheet.

7. A blank in accordance with claim 6 wherein said second set of perforations define circular openings.

8. A blank in accordance with claim 1 wherein said sheet has a plurality of swatch cards laid out therein, each swatch card having said first and second sets of perforations.

9. A blank in accordance with claim 8 wherein said plurality of swatch cards are laid out symmetrically on said sheet.

10. A blank in accordance with claim 8 wherein said swatch cards are substantially rectangular in shape.

11. A blank in accordance with claim 8 wherein said sheet is standard letter or A4 size.

12. A blank in accordance with claim 11 wherein said sheet has a length greater than its width and said swatch cards are substantially equidistantly spaced along said length.

13. A blank in accordance with claim 1 wherein the second set of perforations defines a series of openings running substantially along a longitudinal center axis of the swatch card.

14. A blank in accordance with claim 1 wherein said first and second sets of perforations are laid out symmetrically on said sheet.

15. A blank in accordance with claim 1 wherein said second set of perforations define circular openings.

16. A method for matching a desired color to a computer generated color comprising the steps of:

printing a plurality of computer generated color swatches on a blank form having a first set of perforations defining the perimeter of a swatch card;

removing said swatch card from said blank form along said first set of perforations after said color swatches have been printed thereon; and comparing said desired color to at least one of the computer generated color swatches printed on said swatch card.

17. A method in accordance with claim 16 wherein said blank form has a second set of perforations disposed within said swatch card and intersecting portions of the printed swatches, comprising the further steps of:

removing portions of said swatch card defined by said second set of perforations to create openings in said printed swatches; and laying said swatch card over a desired color to be matched such that the desired color shows through an opening in a printed swatch so that a comparison of the desired color and the printed swatch color can be made.

18. A method in accordance with claim 17 wherein:

said printed swatches are registered on said swatch card such that each swatch has an opening therein defined by perforations of said second set; and the respective perforations of said second set are removed to provide the opening in each printed swatch.

19. A method in accordance with claim 17 wherein said swatch card has a third set of perforations therein defining a corner opening that can be punched out of said card, said method comprising the further steps of:

punching out the corner opening in each of a selected set of said swatch cards; and assembling the selected set of swatch cards into a fan deck by passing a common fastener through the corner openings in the set of swatch cards.

20. A method in accordance with claim 16 wherein at least two swatch cards are printed on said form and removed along respective first sets of perforations.

* * * * *